US005078526A

United States Patent [19]

Corona

[11] Patent Number: 5,078,526

[45] Date of Patent: Jan. 7, 1992

[54] TOOTHBRUSH AND DISPENSER APPARATUS

[76] Inventor: Robert A. Corona, 7151 LaVerne, El Paso, Tex. 79915

[21] Appl. No.: 663,679

[22] Filed: Mar. 4, 1991

[51] Int. Cl.[5] ..... A46B 11/00; B43K 5/06; B43K 29/00; A45D 44/18

[52] U.S. Cl. ..... 401/125; 401/176; 401/195; 401/191; 401/150; 401/284; 401/268; 132/309

[58] Field of Search ..... 401/120, 123-125, 401/131, 150, 176, 195, 284, 268, 191; 132/309, 310

[56] References Cited

U.S. PATENT DOCUMENTS

| | | | |
|---|---|---|---|
| 1,391,459 | 9/1921 | Chaiken | 401/125 |
| 1,653,987 | 12/1927 | Cliffe | 401/125 X |
| 1,704,108 | 3/1929 | Siewert | 401/191 X |
| 2,630,812 | 3/1953 | Dendy | 401/125 |
| 2,652,064 | 9/1953 | Shook | 401/125 |
| 2,856,971 | 10/1958 | Francolino | 401/125 X |
| 3,853,134 | 12/1974 | McCord | 401/195 X |
| 4,122,983 | 10/1978 | Jolly | 401/175 X |
| 4,759,381 | 7/1988 | Cesari | 401/191 X |
| 4,950,095 | 8/1990 | Picard | 401/195 X |

FOREIGN PATENT DOCUMENTS

| | | | |
|---|---|---|---|
| 2085717 | 5/1982 | United Kingdom | 401/268 |

*Primary Examiner*—Danton D. DeMille
*Attorney, Agent, or Firm*—Leon Gilden

[57] ABSTRACT

An apparatus wherein an elongate, coaxially aligned housing is defined by a first chamber mounting a floor adjacent a lower terminal end of the housing, with the floor including a chamber floor underlying the floor, and a removable lid for rotatably mounting a dental floss spool therewithin. A piston is slidably mounted overlying and spaced from the floor to define a toothpaste chamber therebetween, wherein the piston mounts a dispensing boss, including a plurality of ports, wherein a plurality of spaced, parallel rails are diametrically mounted on the piston spaced from the dispensing boss, with a recess positioned within a top surface of the piston for receiving an upper terminal end of the toothbrush therebetween to position the toothbrush in alignment with the dispensing boss. A second chamber is fixedly mounted coextensively with the housing adjacent a side wall thereof for receiving the toothbrush therewithin.

2 Claims, 4 Drawing Sheets

TOOTHBRUSH AND DISPENSER APPARATUS

BACKGROUND OF THE INVENTION

1. Field of the Invention

The field of invention relates to toothbrush apparatus, and more particularly pertains to a new and improved toothbrush and dispenser apparatus wherein the same is arranged for storage of an associated toothbrush for subsequent positioning of the toothbrush in an orientation to accommodate toothpaste expressed thereon.

2. Description of the Prior Art

Toothpaste dispensing apparatus has been utilized in the prior art, wherein typically a hollow handle toothbrush accommodates a magazine storing toothpaste therewithin. Such apparatus is found for example in U.S. Pat. Nos. 4,135,831 to Reitkecht; U.S. Pat. No. 3,399,947 to Fallesen., and U.S. Pat. No. 4,277,194 to Smith.

Typically, the conduits to direct such toothpaste into the bristles are subject to clogging and the like, wherein the instant invention utilizes an organization to mount an associated toothbrush in a proper orientation relative to a dispensing boss.

As such, it may be appreciated that there continues to be a need for a new and improved toothbrush and dispensing apparatus as set forth by the instant invention which addresses both the problems of ease of use as well as effectiveness in construction in positioning a toothbrush in a readily repeated orientation relative to a dispensing boss to properly position toothpaste onto associated bristles of the toothbrush and as such, the present invention substantially fulfills this need.

SUMMARY OF THE INVENTION

In view of the foregoing disadvantages inherent in the known types of toothbrush apparatus now present in the prior art, the present invention provides a toothbrush and dispenser apparatus wherein the same orients a toothbrush in a desired orientation relative to a dispensing boss. As such, the general purpose of the present invention, which will be described subsequently in greater detail, is to provide a new and improved toothbrush and dispenser apparatus which has all the advantages of the prior art toothbrush apparatus and none of the disadvantages.

To attain this, the present invention provides an apparatus wherein an elongate, coaxially aligned housing is defined by a first chamber mounting a floor adjacent a lower terminal end of the housing, with the floor including a chamber floor underlying the floor, and a removable lid for rotatably mounting a dental floss spool therewithin. A piston is slidably mounted overlying and spaced from the floor to define a toothpaste chamber therebetween, wherein the piston mounts a dispensing boss, including a plurality of ports, wherein a plurality of spaced, parallel rails are diametrically mounted on the piston spaced from the dispensing boss, with a recess positioned within a top surface of the piston for receiving an upper terminal end of the toothbrush therebetween to position the toothbrush in alignment with the dispensing boss. A second chamber is fixedly mounted coextensively with the housing adjacent a side wall thereof for receiving the toothbrush therewithin.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved toothbrush and dispenser apparatus which has all the advantages of the prior art toothbrush apparatus and none of the disadvantages.

It is another object of the present invention to provide a new and improved toothbrush and dispenser apparatus which may be easily and efficiently manufactured and marketed.

It is a further object of the present invention to provide a new and improved toothbrush and dispenser apparatus which is of a durable and reliable construction.

An even further object of the present invention is to provide a new and improved toothbrush and dispenser apparatus which is susceptible of a low cost of manufacture with regard to both materials and labor, and which accordingly is then susceptible of low prices of sale to the consuming public, thereby making such toothbrush and dispenser apparatus economically available to the buying public.

Still yet another object of the present invention is to provide a new and improved toothbrush and dispenser apparatus which provides in the apparatuses and methods of the prior art some of the advantages thereof, while simultaneously overcoming some of the disadvantages normally associated therewith.

Still another object of the present invention is to provide a new and improved toothbrush and dispenser apparatus wherein the same is arranged to orient a toothbrush and utilize a toothbrush as a plunger to permit metered application of toothpaste onto the toothbrush.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
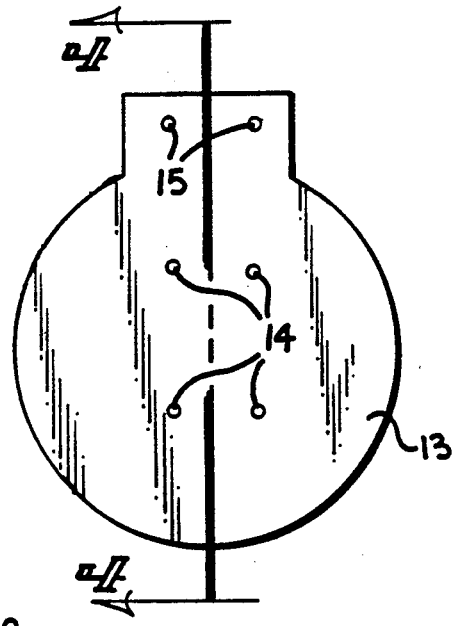
FIG. 1 is a top orthographic view of the instant invention.
Figure 2:
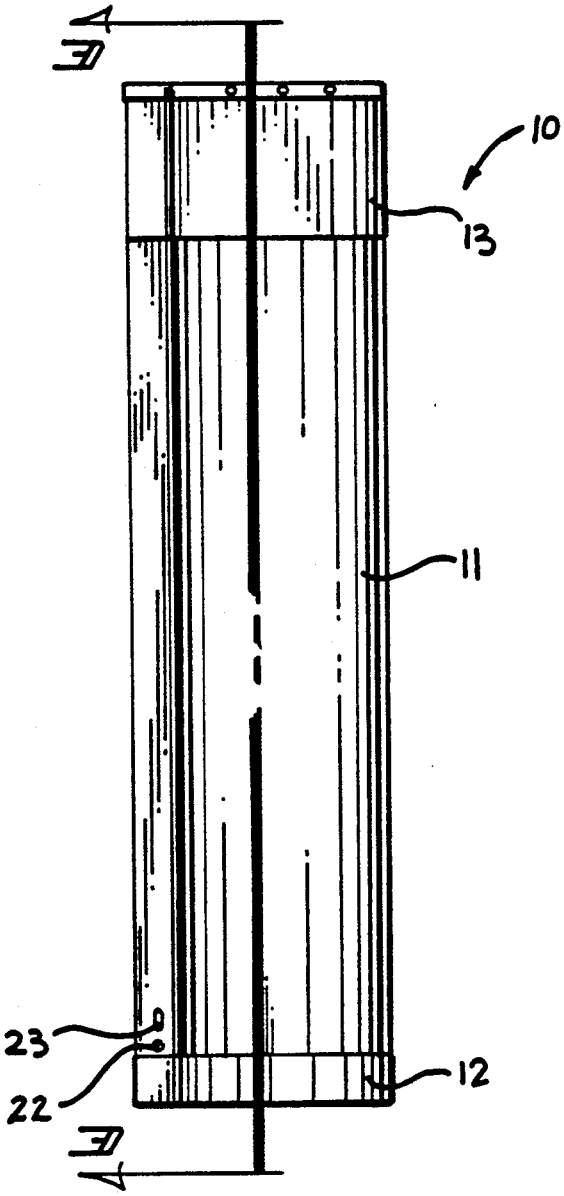
FIG. 2 is an orthographic side view of the instant invention.

With reference now to the drawings, and in particular to FIGS. 1 to 5 thereof, a new and improved toothbrush and dispenser apparatus embodying the principles and concepts of the present invention and generally designated by the reference numeral 10 will be described.

Figure 3:
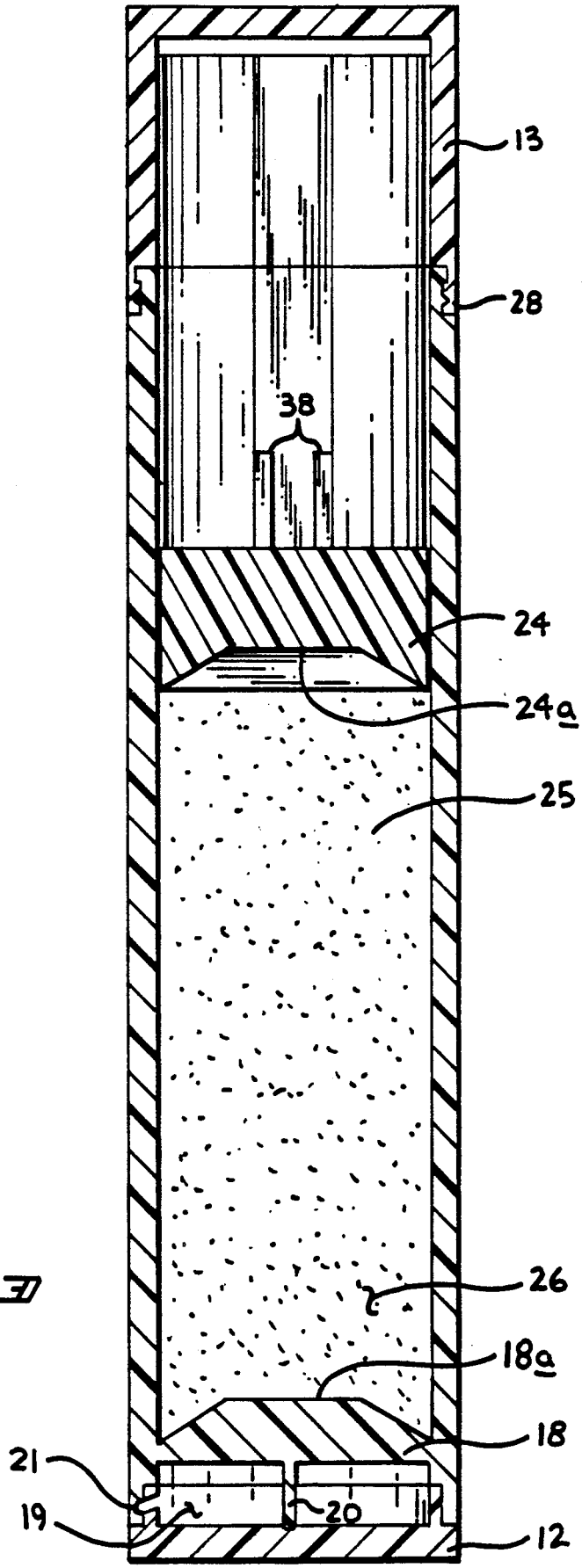
FIG. 3 is an orthographic view, taken along the lines 3—3 of FIG. 2 in the direction indicated by the arrows.
Figure 4:
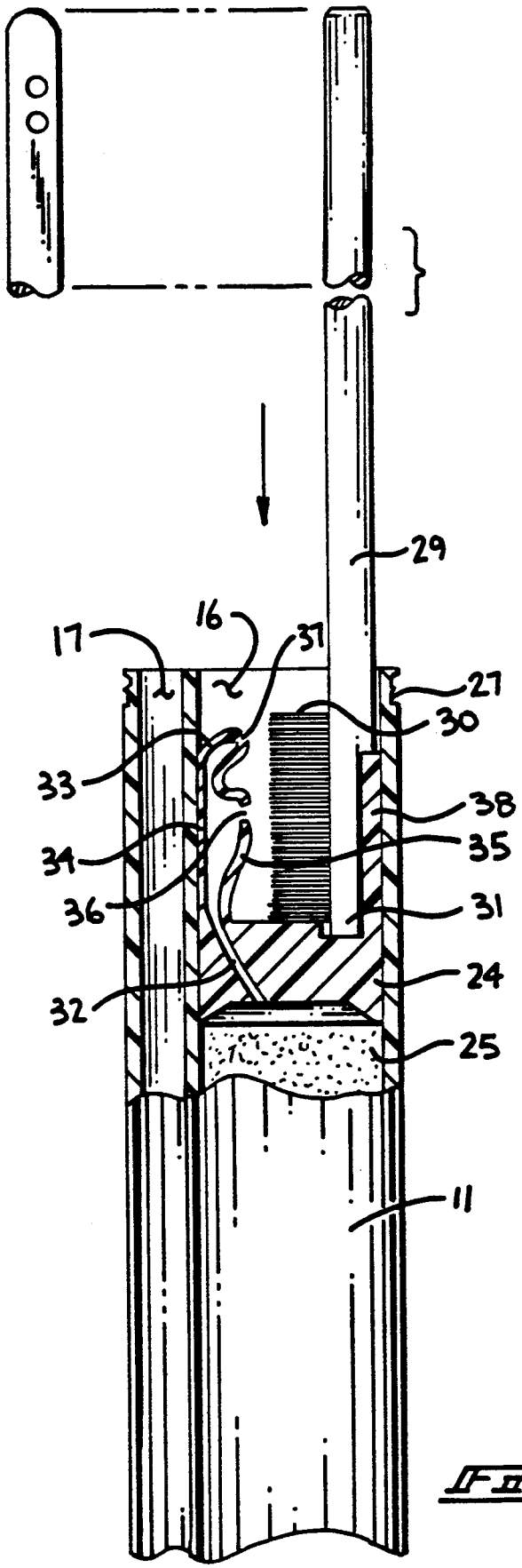
FIG. 4 is an orthographic view, taken along the lines 4—4 of FIG. 1 in the direction indicated by the arrows with the lid removed therefrom.
Figure 5:
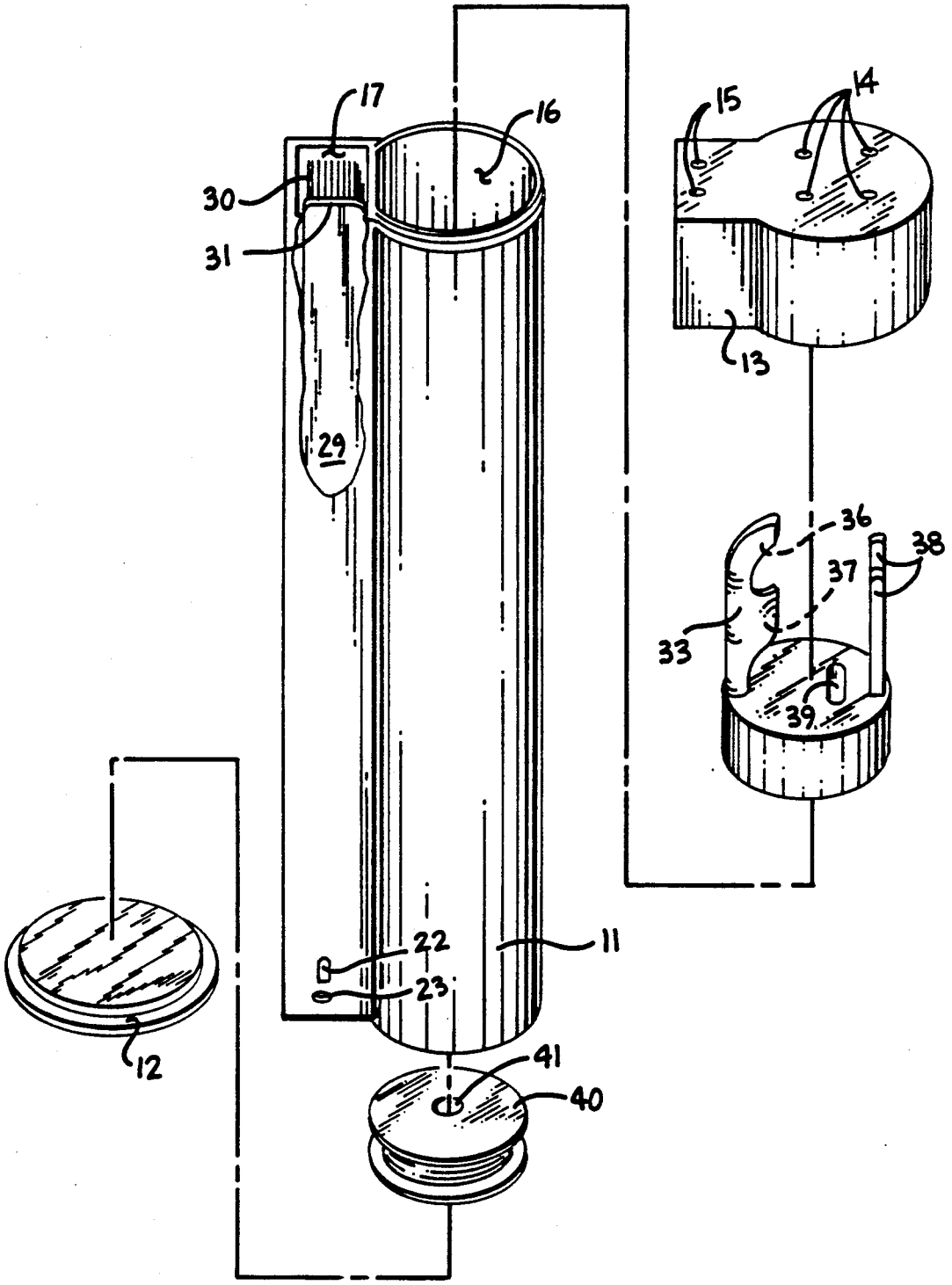
FIG. 5 is an isometric exploded illustration of the instant invention.

More specifically, the toothbrush and dispenser apparatus 10 of the instant invention essentially comprises an elongate, coaxially aligned housing 11 that includes a removable bottom lid 12 mounted to a bottom of the housing, and a removable top lid 13 mounted to an upper terminal end portion of the housing, wherein the top removable lid 13 includes a cylindrical flange 28 receivable within an annular recess 27 (see FIGS. 3 and 4). The removable top lid 13 includes a plurality of first air vents 14 directed through a central portion of the lid, with a plurality of second air Vents 15 directed through a second portion of the lid formed as a rectangular projection radially oriented relative to the first portion, wherein the first air vents 14 overlie a first chamber 16 of a generally cylindrical configuration, and the second air vents 15 overlie a second chamber 17 of a generally rectangular parallelepiped configuration, wherein the second chamber 17 is directed coextensively with and axially spaced from an axis defined by the housing 11 first chamber 16. The second chamber 17 mounts a toothbrush 29 removably therefrom, such as illustrated in FIG. 5 for example. The first chamber 16 includes a first chamber floor 18 orthogonally and integrally mounted within the first chamber adjacent to and spaced from the lower terminal edge of the housing 11, wherein the lower terminal edge of the housing receives the bottom lid 12 thereon in a spaced relationship relative to the floor 18 to define a dental floss cylindrical chamber 19 therewithin, wherein the dental floss chamber includes an axle 20 coaxially aligned with the axis of the first chamber 16. The dental floss chamber 19 is in communication with a dental floss conduit 21 that is directed through the side wall of the housing 11 and terminates in an outlet port 22 that projects through the second chamber into an outer wall of the first chamber cooperative with a cutter plate 23 mounted on the exterior wall of the second chamber to selectively sever dental floss directed through the outlet port 22.

A cylindrical piston 24 is mounted within the first chamber spaced above the floor 18. The piston 24 includes a concave recess **24*a* cooperative with and complementarily receiving a convex projection 18*a* formed to a top surface of the floor 18 to enhance expressing of toothpaste 26 positioned within the toothpaste chamber 25 defined between the piston 24 and the floor 18**.

As illustrated, the toothbrush 29 includes a matrix of bristles 30 mounted to the toothbrush, with the toothbrush further including a toothbrush bristle base 31 whose outer terminal end projects beyond the bristles 30 and is receivable within a recess 39 formed through a top surface of the piston 24, to be discussed in greater detail below.

The piston 24 includes a piston conduit 32 directed through the piston in communication with the toothpaste chamber 25 directed from the bottom surface of the piston **24*a*, and wherein the piston conduit 32 is directed through a top surface of the piston 24 into a hollow dispensing boss 33. The hollow dispensing boss 33 includes a rear wall 34 that is slidably mounted in contiguous communication with an interior wall of the first chamber 16 and integrally and fixedly mounted to a top surface of the piston 24. A forward wall 35 of the dispensing boss 33 includes a first forward wall port 36 and a second forward wall port 37 that are aligned relative to one another and are parallel and spaced from the axis of the first chamber 16. It is desired that the first opening of the first port 16 be of a lesser size than the second opening defined by a second defined by the second port 37 in directing toothpaste in an efficient manner upon a top surface of the bristles 30 of the toothbrush when positioned, as illustrated in FIG. 4, on the top surface of the piston 24**.

A plurality of parallel rails 38 are mounted orthogonally to a top surface of the piston 24 and are diametrically opposed to the hollow dispensing boss 33 and spaced apart a predetermined spacing to receive the toothbrush therewithin to properly align a toothbrush relative to the first and second wall ports 36 and 37 respectively. To this end, a recess 39 mounted into the top surface of the piston 24 is positioned between the parallel rails 38 and the dispensing boss 33 to receive the terminal end of the toothbrush bristle base 31 therewithin. In this manner, when the toothbrush is thusly positioned as illustrated in FIG. 4, the toothbrush is directed into the first chamber 16 to effect expressing of toothpaste 26 through the conduit 32 and into the hollow dispensing boss 33 through the respective first and second ports 36 and 37.

It should be further noted that a spool 40 mounting a quantity of dental floss wound thereabout includes a central axial bore 41 that is captured on the axle 20 to properly align the spool 41 within the dental floss chamber 19 permitting non-binding directing of dental floss through the dental floss conduit 21.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toothbrush and dispenser apparatus comprising, in combination, an elongate housing, the housing including an upper terminal end and a lower terminal end, the upper terminal end including a top lid removable therefrom, and the lower terminal end including a bottom lid removable therefrom, the elongate housing including a first chamber coextensively directed through the elongate housing, with the first chamber defined by a cylindrical configuration, and a second chamber coextensively and contiguously mounted adjacent the first chamber, and a toothbrush member, the toothbrush member including an elongate handle and the handle including a bristle brush matrix mounted to the handle defined by a handle base projecting beyond the toothbrush matrix, and the toothbrush member slidably and removably mounted within the second chamber, and the first chamber including a first chamber floor spaced above the lower terminal end of the housing defining a dental floss chamber therewithin between the bottom lid and the first chamber floor, and a piston slidably mounted within the first chamber between the first chamber floor and the housing upper terminal end, and a piston conduit directed through the piston, and a toothpaste chamber defined between the piston and a top surface of the floor, whereupon projection of the piston towards the floor expresses fluid through the piston conduit to the toothpaste from the toothpaste chamber onto the associated bristle matrix of the toothbrush member, and wherein the floor includes a bottom surface, the bottom surface including an axle fixedly mounted to a bottom surface of the floor extending orthogonally between the bottom surface of the floor and the lid, and a spool, the spool including a central bore rotatably mounted about the axle, and a dental floss conduit directed from the dental floss chamber through the housing, and including a port directed exteriorly of the housing, with the outlet port in communication with the dental floss chamber, and a cutter member positioned upon the housing spaced from and adjacent the dental floss outlet port to effect selective severing of dental floss directed from the outlet port, and wherein the floor includes a top surface, the top surface formed of a predetermined convex configuration, the piston including a piston bottom surface, the piston bottom surface defined by a predetermined concave configuration, wherein the concave configuration complementarily receives a convex configuration upon projection of the piston over the floor to enhance removal of toothpaste from the toothpaste chamber defined between the piston and the floor, and wherein the piston conduit is directed through a top surface of the piston into a dispensing boss, the dispensing boss formed of a hollow configuration and fixedly and orthogonally mounted to the top surface of the piston and in sliding contiguous communication with an interior surface of the first chamber, and the dispensing boss including a forward wall, with the forward wall diametrically aligned with the top surface of the piston, and the forward wall including a first forward wall port and a second forward wall port to effect expressing of toothpaste through the first and second forward wall port, and a plurality of parallel rails fixedly and orthogonally mounted to the top surface of the piston diametrically opposed to the dispensing boss, with the parallel rails positioned in contiguous and sliding communication with the interior surface of the first chamber, wherein the parallel rails are spaced apart a predetermined spacing to complementarily receive the toothpaste base therebetween, and a recess positioned between the dispensing boss and the parallel rails in alignment with the dispensing boss and the parallel rails to receive the free terminal end of the toothbrush base therewithin to enhance alignment of the toothbrush within the top surface of the piston.

2. An apparatus as set forth in claim 1 wherein the top lid includes a plurality of first vents overlying the first chamber and a plurality of second vents overlying the second chamber.

* * * * *